United States Patent [19]

Bodtke

[11] Patent Number: 5,027,510

[45] Date of Patent: Jul. 2, 1991

[54] DISPOSABLE RAZOR

[75] Inventor: Robert G. Bodtke, Arlington Heights, Ill.

[73] Assignee: IRAD, Inc., Arlington Heights, Ill.

[21] Appl. No.: 441,274

[22] Filed: Nov. 27, 1989

[51] Int. Cl.[5] ..... B26B 21/00

[52] U.S. Cl. ..... 30/47; 30/32; 30/85

[58] Field of Search ..... 30/47, 32, 85, 86; 16/110

[56] References Cited

U.S. PATENT DOCUMENTS

| | | | |
|---|---|---|---|
| 1,875,990 | 9/1932 | Christmas . | |
| 1,975,365 | 10/1934 | Levitt et al. | 30/12 |
| 1,985,132 | 12/1934 | Woods | 30/12 |
| 1,991,290 | 2/1935 | McGirr et al. | 30/12 |
| 2,075,007 | 3/1937 | Christmas | 30/47 |
| 2,445,528 | 7/1948 | Keogh, Jr. | 30/41 |
| 2,589,327 | 3/1952 | Biggs | 30/47 |
| 2,694,857 | 11/1954 | Koval | 30/47 |
| 2,699,602 | 1/1955 | Finley | 30/47 |
| 2,716,810 | 9/1955 | Koval | 30/47 |
| 2,729,887 | 1/1956 | Appeldorn | 30/41 |
| 2,871,560 | 2/1959 | Eberbaugh | 30/47 |
| 3,367,482 | 2/1968 | Samsing | 206/16 |
| 3,492,723 | 2/1970 | Mollica et al. | 30/47 |
| 3,750,280 | 8/1973 | LePaliscot et al. | 30/85 |
| 4,439,920 | 4/1984 | Nauheimer | 30/47 |
| 4,485,554 | 12/1984 | Bergamaschi | 30/50 |
| 4,554,735 | 11/1985 | Chen | 30/47 |
| 4,712,301 | 12/1987 | Saito | 30/47 |

FOREIGN PATENT DOCUMENTS

| | | | |
|---|---|---|---|
| 1562173 | 3/1980 | United Kingdom | 21/52 |

*Primary Examiner*—Timothy V. Eley
*Assistant Examiner*—WIllmon Fridie, Jr.
*Attorney, Agent, or Firm*—Olson & Hierl

[57] ABSTRACT

A relatively inexpensive, disposable and foldable razor comprises a single, die-cut sheet of material that includes a series of unique folds which define a handle portion, a blade holding portion and a blade supporting portion which receive and hold a blade in a stationary position during use. The device is compact and foldable for efficient storage.

21 Claims, 2 Drawing Sheets

DISPOSABLE RAZOR

FIELD OF THE INVENTION

The present invention relates to shaving instruments and in particular to a relatively inexpensive, foldable and disposable razor.

BACKGROUND OF THE INVENTION

Disposable safety razors have been available for some time. The most commercially successful disposable razors are plastic, injection-molded devices. While such disposable razors generally provide satisfactory shaving performance, these devices do exhibit several disadvantages. For example, the design of each razor is relatively complex and includes several interlocking pieces such as the handle, razor head and blade guard, which must be molded separately and assembled along with a blade. This adds to the expense of the product.

In addition, the injection molding process itself has several drawbacks. The equipment needed for injection molding is quite costly and requires a considerable degree of upkeep and maintenance. This is particularly true when considering the small tolerances needed to efficiently mass produce an injection-molded razor. Moreover, the process of injecting and hardening a plastic in a mold takes time, and production is limited further by the number and complexity of the molds. Finally, post-injection molding processes which include trimming, flashing and degating add further time constraints and expense to the manufacturing process.

In addition to the disadvantages of injection molding, currently available disposable razors are no more compact for efficient storage during shipping and travel than standard, reusable safety razors.

One method of making disposable razors more compact for storage has been the design of foldable-type razors. Despite numerous attempts to design such a foldable disposable razor, each such design has been flawed to the extent that no design has achieved any notable commercial success.

The flaws of these foldable-type disposable razors generally fall into three categories. Many of these devices are simply too pliable to maintain the precise shaving head angle needed for safe and effective use. In an effort to provide the proper shaving head angle, many of these devices add a degree of complexity which includes the introduction of several parts and even resort to the use of injection molded components as supporting means about the blade area. Of course, these measures add considerably to the cost of manufacturing the product.

Secondly, adhering the blade in a stationary position so it will not shift during use is a problem. In many of these devices, this is accomplished through use of a separate, external connecting means such as staples or pins. Again, such additional components can add considerably to the cost of such devices.

Lastly, these devices often require numerous manufacturing steps which again add to the cost. An example may be found in co-pending U.S. Ser. No. 333,123 which was filed in the name of Vincent J. Nauheimer and which is owned by the assignee of this application. Although this construction is a marked improvement over the prior art, it does include tabs which are (1) folded or folded and twisted, and (2) glued or inserted through apertures or slots to support this blade at the desired angle. Any design which reduces the number of stamping, cutting, scoring or folding operations simplifies the manufacturing process and improves the profitability of these razors.

Thus, a need exists for a foldable-type disposable razor which provides the necessary blade adherence and stability of the blade head angle to ensure a safe shave while reducing or avoiding costly production steps.

SUMMARY OF THE INVENTION

The present invention relates to a disposable razor formed from a single, die-cut sheet of material. The design eliminates the use of molded parts which is an inherent part of the manufacture of all commercially successful disposable razors. This is accomplished by providing a series of unique folds in the sheet of material along a series of score lines which define a handle portion, a blade holding portion and a blade supporting portion adapted to hold a razor blade.

The handle portion comprises a rear wall and a pair of side walls disposed on each side of the rear wall. In a preferred embodiment, the rear wall is substantially rectangular and the side walls are generally trapezoidal in shape.

The blade holding portion includes a first blade holding panel and a second blade holding panel having a support panel extending therefrom, the second blade holding panel is foldably connected to the first blade holding panel.

The blade supporting portion comprises a rear supporting wall associated with the rear wall of the handle portion, and a pair of side walls which are disposed on each side of the rear wall of the blade supporting portion and are associated with the side walls of the handle portion. In a preferred embodiment, the rear wall of the blade supporting portion is generally triangular and trapezoidal shaped and the side walls are generally triangular.

The first blade holding panel of the blade holding portion includes an aperture through which the cutting edge of the blade extends. Limited assembly includes adding a blade between the first and second blade holding panels, folding the first blade holding panel against the second blade holding panel and securing the first blade holding panel to the second blade holding panel so that the cutting edge of the blade extends through the aperture. A support panel extending from the proximal end of the second blade holding panel is secured to the rear wall so that the rear wall and the assembled blade holding portion are disposed generally perpendicularly from each other. Use of the support panel instead of tabs as in the previously referenced Nauheimer construction eliminates the costly production steps associated with twisting and then folding the scored tabs.

The present invention thus provides the necessary blade adherence and blade head angle stability for a safe shave. The stability is achieved without the use of costly injection molding or the addition of a plurality of parts or tabs.

BRIEF DESCRIPTION OF THE DRAWINGS

In the drawings, which comprise a portion of this disclosure.

DETAILED DESCRIPTION OF A PREFERRED EMBODIMENT

Figure 1:
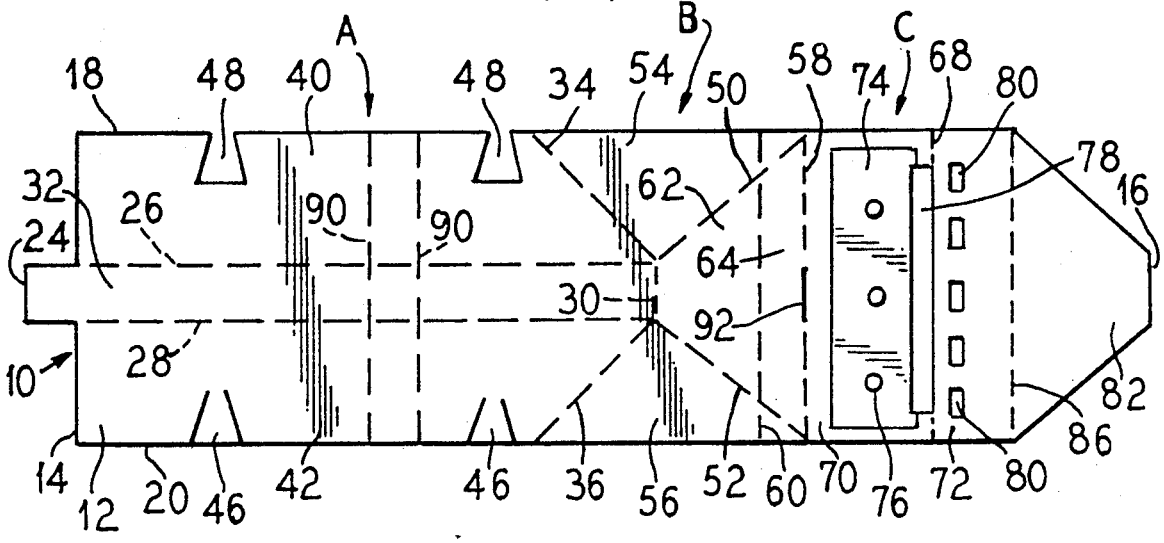
FIG. 1A-1D is a top view of the pattern of "blank" of a preferred embodiment according to the present invention.

Referring to FIG. 1, a "blank" of a preferred embodiment of the present invention is shown after die-cutting and scoring and prior to limited assembly. Because the present invention features a unitary construction free of add-on parts, with the exception of the blade, the blank of the present device is designated, as is the completed disposable razor, by the reference numeral 10.

The blank 10 comprises a generally rectangular sheet of low cost material 12 that is foldable, but rigid, and is moisture resistant. Representative materials include plastic, treated cardboard, treated paper and similar materials which can include Mylar-coated and foil-coated paper stock.

The generally rectangular sheet includes a distal edge 14, a proximal edge 16 and two elongated edges 18 and 20. The generally rectangular sheet 12 shown in FIG. 1 also includes a series of cuts designated by solid lines, temporary folds designated by dashed lines and permanent folds designated by dotted lines. In an alternative embodiment, the sheet 12 can also include a recessed area designated by a shaded portion which can serve as a guide for proper placement of the blade.

Extending from the distal edge 14 of the generally rectangular sheet 12 is a tab 24 which secures the assembled disposable razor 10 in the closed or folded position, as will be explained in greater detail.

Extending longitudinally from the tab 24 are two substantially parallel score lines 26 and 28. A relatively short, upper transverse score line 30 connects the proximal ends of the two substantially parallel score lines 26 and 28. The upper transverse score lines 26 and 28 define a generally rectangular rear wall 32 of a handle portion A.

Extending from the junction of the substantially parallel score lines 26 and 28 and the upper transverse score line 30 are a pair of mirrored score lines 34 and 36 which are angled distally towards the elongated edges 18 and 20 of the generally rectangular sheet 12.

The substantially parallel score lines 26 and 28 and the two mirrored distally angled score lines 34 and 36 define two trapezoidal side walls 40 and 42 of the handle portion. Thus, the rear wall 32 and the side walls 40 and 42 form the handle portion of the razor.

The handle portion can include means for securing the side walls 40 and 42 together In the illustrated embodiment, this securing means can include a pair of generally triangular tabs 46 extending from one side wall 42 and corresponding generally triangular tab cutouts 48 on the second side wall 40 of the handle portion. When the device is assembled, the side walls 40 and 42 are rotated together about the substantially parallel longitudinal score lines 26 and 28, as is discussed in more detail below. When so rotated, the tabs 46 can be inserted into the cut-outs 48 to form the handle portion. In the alternative, a strip of double-sided tape can be positioned between the side walls 40 and 42 to secure the side walls together.

Also extending from the junction of the two substantially parallel longitudinal score lines 26 and 28 and the upper transverse score line 30 are a pair of mirrored score lines 50 and 52 which are angled proximally towards the elongated edges 18 and 20 of the generally rectangular sheet 12. With the distally angled score lines 34 and 36 and the upper transverse score line 30, the proximally angled score lines 50 and 52 generally from an "X" configuration. This configuration defines three generally triangular sections including two side walls 54 and 56 of a blade supporting portion B.

Extending from the junctions of the two proximally angled score lines 50 and 52 and the respective elongated edges 18 and 20 of the rectangular sheet 12 is a transverse score line 58. The transverse score line 58 along with the two proximally angled score lines 50 and 52 and the upper transverse score line 30 form a trapezoidal rear wall 62 of the blade supporting portion which is generally triangular in shape and defines the third of the generally triangular sections formed by the "X" configuration. The rear wall 62 and the two side walls 54 and 56 comprise the blade supporting portion.

An additional transverse score line 68 divides the remaining proximal portion of the blank 10 into a first, generally rectangular blade holding panel 70 and a second, generally rectangular blade holding panel 72, which together form a blade holding portion C of the razor.

The first blade holding panel 70 can include, but need not include, recessed area 74 stamped into the blank 10 which serves as a guide for the proper placement of the blade. Included in the recessed area 74 is at least one raised extension 76 which can be formed by not depressing that portion of the blank. These extensions 76 correspond to performed openings defined in the blade which is conventional practice are typically secured by expensive, separately molded pins, thus providing blade stability without this added expense.

The first blade holding panel 70 can also optionally define a blade aperture 78 while the second blade holding panel 72 defines a plurality of smaller openings 80 proximal to the blade aperture 78. When a blade is positioned in the recessed area 74 of the first blade holding panel 70 and the second blade holding panel 72 is folded and secured under the blade, the edge of the blade can extend through the blade aperture 78 while the smaller openings 80 are disposed below the blade to provide for egress of water and shaving cream. This construction, however, is not essential.

Also provided on the second blade holding panel 72 along the proximal edge 16 of the blank is a support panel 82. The support panel 82 defines a trapezoidal shape. The support panel 82 when properly secured with an adhesive to the rear wall 62 ensures the precise shaving angle of the blade. At the same time, the support panel 82 maintains an angle rigid enough for shaving and allows the blank to be formed from a single die-cut sheet. The support panel 62 may also be secured to the side walls 54 and 56 by providing foldable extensions 84 along the sides of the support panel 82.

Figure 3:
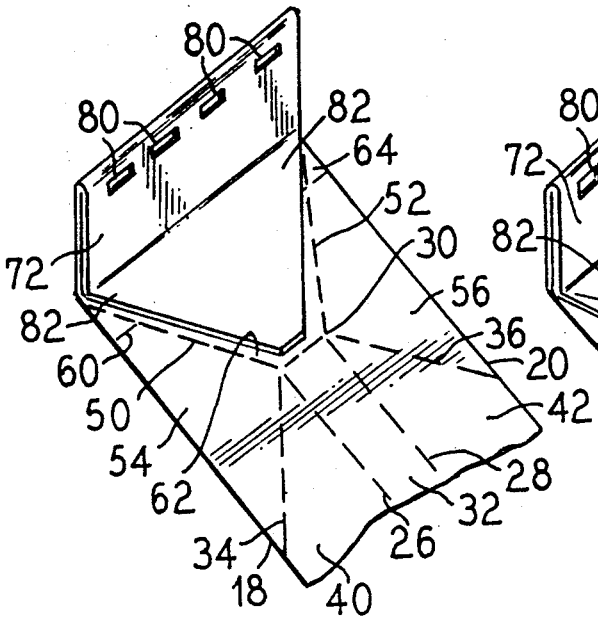
FIG. 3 is a partial perspective view of the assembled blade holding and supporting portions of the device of FIG. 1.

The three proximal edges of the support panel 82 meet on the rear wall 62. Support panel 82 may be cut to exactly the size of rear wall 62 thereby maximizing the adhesive area. At the same time, the support panel 82 does not interfere with the forming of the handle defined by score line 36, score line 52 and score line 28 and corresponding score lines 34, 50 and 26, respectively. FIG. 3 demonstrates the foregoing. The support panel 82 forms a brace that holds the head rigid at the proper angle.

Figure 6:
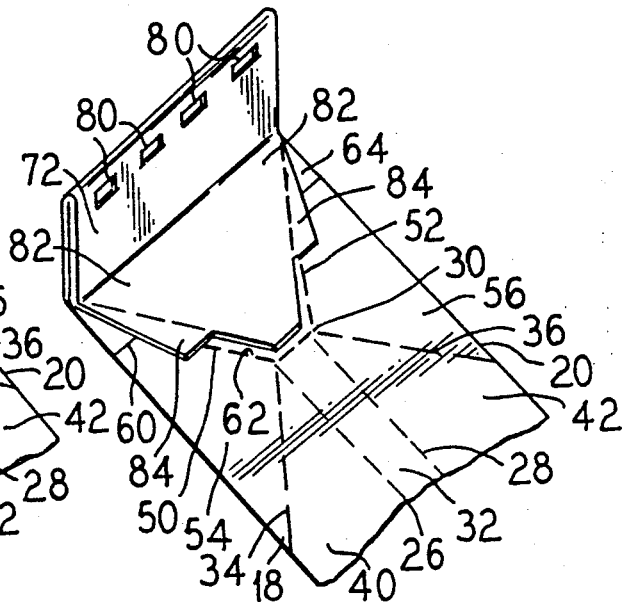
FIG. 6 is a partial perspective view of an alternative embodiment of the blade holding and supporting portions of the device.

FIG. 6 illustrates the aforementioned alternative embodiment which includes the foldable extensions 84 which can be secured by an adhesive to the side walls 54 and 56. The extensions 84 along the sides of the support panel 82 do not extend to the elongated edges 18 and 20 of the blank. As a result, when the device is folded for use, the extensions 84 do not protrude beyond the edges 18 and 20.

Referring again to FIG. 1, one or more optional transverse score lines 60 may extend across the proximally angled score lines 50 and 52 and be generally parallel to the transverse score line 58. Additional control over the shaving angle of the blade is available through placement of transverse score line 60. The transverse score lines 58 and 60 define an intermediate panel 64.

Referring now to FIG. 2, the necessary limited assembly is described. As is shown in FIG. 2A, the completed die-cut, scored blank comprises a single, unitary sheet of material with no additional pieces (other than the blade).

Figure 2A:
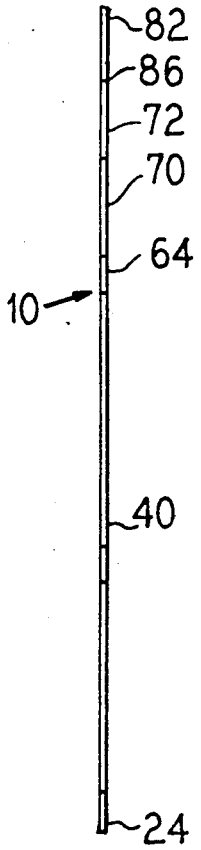
FIGS. 2A-2D are side elevational views of the device of FIG. 1 in various stages of assembly.
Figure 2B:
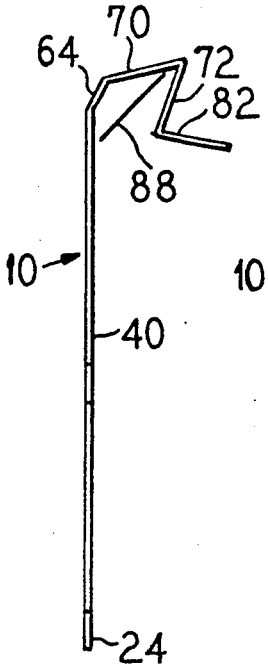

To assemble the device, the support panel 82 extending from the proximal edge 16 of the blank is folded along the score line 86 so that the support panel 82 extends generally perpendicularly from the second blade holding panel 72, as is shown in FIG. 2B.

A blade 88 is provided disposed between the first and second blade holding panels 70 and 72 positioned in the recessed area 74 of the first blade holding panel 70. The blade 88 can also include disposed therebelow comb fingers (not shown) which work in conjunction with the plurality of smaller openings 80 to provide water and shaving cream egress. The second blade holding panel 72 is then folded against the first blade holding panel 70 and the two are secured together. The support panel 82 is then secured to the rear wall 32, as shown in FIG. 2C and FIG. 3.

To provide the foldable package for shipping or travel, the blank is further folded about at least one auxiliary score line 90 (see, for example, FIG. 1) provided across the rear wall 32 of the handle portion and the side walls 40 and 42; then the generally square tab 24 is inserted into an opening 92 (see FIG. 1) provided in the intermediate panel 64. In this folded position, the present device can be compactly stored and is particularly appropriate for shipping or travel (FIG. 2D).

Figure 2C:
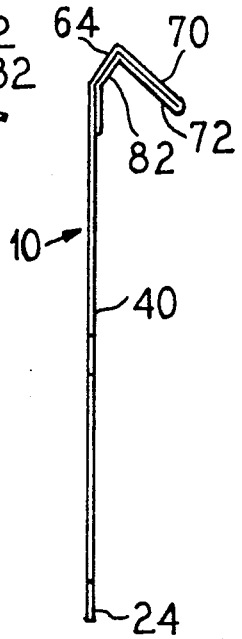
Figure 2D:
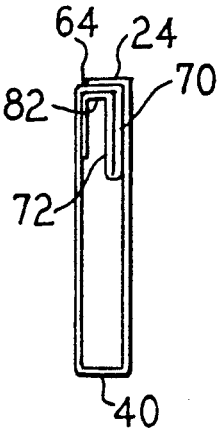
Figure 4:
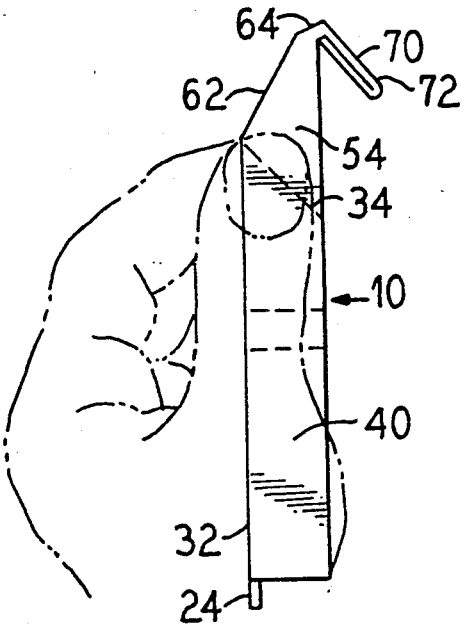
FIG. 4 is a side elevational view of the assembled device of FIG. 1.
Figure 5:
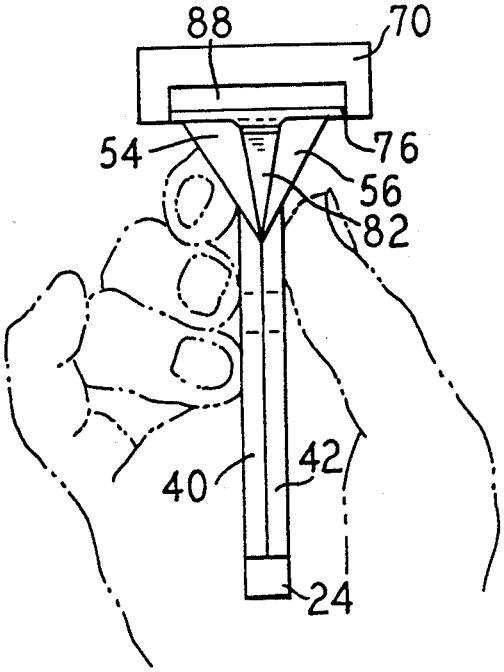
FIG. 5 is a front elevational view of the assembled device of FIG. 1.

For use, the device is returned to the unfolded position shown in FIG. 2C, and the side walls 40 and 42 of the handled portion are rotated around the generally parallel longitudinal score lines 26 and 28. This is preferably accomplished by grasping the device 10 between the thumb and fingers, with this grip securing the device 10 in the use position, as is seen in FIGS. 4 and 5.

By forming the razor from a single die-cut sheet, the sheet can be printed before cutting. As a result, the individual blanks cut from the sheet can be labeled prior to manufacture. Currently, all molded plastic razors must be individually handled and labelled after manufacturing by either hot stamping, adhesive labels or etching. As is evident, the cost savings can be considerable. However, cost savings is only one advantage of using a preprinted sheet. Another advantage is that it allows for the use of multicolor screened graphics of any type. This is a new development in the razor business and provides new opportunities for use of the device both as a premium item and as a privately labelled product.

It should be understood that various modifications, changes, and variations in addition to those herein discussed may be made in the arrangement, operation and details of construction and assembly of the elements disclosed herein without departing from the spirit and scope of the invention.

What is claimed is:

1. A disposable, foldable razor comprising:

a handle portion, a blade holding portion and blade supporting portion;

the handle portion including a rear wall having a pair of elongated sides and a pair of side walls extending from and foldably connected to the elongated side of the rear wall;

the blade holding portion including a first blade holding panel and a second blade holding panel foldably connected to the first blade holding panel, the second blade holding panel defining an aperture such that when the blade is placed between the first and second blade holding panels and the first and second blade holding panels are folded together, the blade can extend through the aperture;

the blade supporting portion including a rear wall extending from and foldably connected to the rear wall of the handle and the first blade holding panel, a pair of side walls extending from and foldably connected to each side of the rear wall of the blade supporting portion and to the side walls of the handle portion and a support panel foldably connected to the second blade holding panel opposite the first blade holding panel, the support panel being secured to the blade supporting portion when the first and second blade holding panels are secured together;

whereby the support panel, the rear wall and the first and second blade holding panels can be folded to secure the blade in a stationary position.

2. The disposable, foldable razor of claim 1 wherein the support panel is secured to the rear wall of the blade supporting portion.

3. The disposable, foldable razor of claim 1 wherein the support panel includes at least one extension along a side thereof secured to the blade supporting portion.

4. The disposable, foldable razor of claim 1 wherein the support panel includes a pair of foldable extensions along opposite side thereof secured to the corresponding side walls of the blade supporting portion.

5. The disposable, foldable razor of claim 1 wherein the first blade holding panel further includes a plurality of openings.

6. The disposable, foldable razor of claim 1 wherein the second blade holding panel further includes a recessed section adapted to receive the blade.

7. The disposable, foldable razor of claim 1 wherein the side walls of the handle portion further include means for securing the side walls together.

8. The disposable, foldable razor of claim 7 wherein the securing means comprises an adhesive.

9. The disposable, foldable razor of claim 7 wherein the securing means includes at least one tab disposed on one side wall of the handle portion and a corresponding cut-out portion disposed on the second side wall of the handle portion.

10. The disposable, foldable razor of claim 1 wherein the blade supporting portion further includes at least one intermediate panel foldably connected to the rear wall of the blade supporting portion and the first blade holding panel.

11. A disposable, foldable razor comprising a generally rectangular sheet of material including a distal edge, a proximal edge and two elongated edges, the sheet of material including:

(a) a pair of generally parallel, longitudinal score lines having upper ends and extending from the distal edge and a transverse score line disposed between the upper ends of the longitudinal score lines, the longitudinal score lines and the transverse score line defining a rear wall of the handle portion;

(b) a pair of mirrored, angled score lines extending distally from the junction of the transverse score line and the longitudinal score lines to the elongated edges of the generally rectangular sheet of material, the distally angled score lines defining with the longitudinal score lines a pair of side walls of the handle portion, the pair of side walls and the rear wall together defining the handle portion;

(c) a second pair of mirrored, angled score lines extending proximally from the junction of the transverse score line and the longitudinal score lines to the elongated edges of the sheet of material, the distally and proximally angled score lines together defining a pair of side walls of a blade supporting portion;

(d) a transverse score line extending from the junction of each of the proximally angled score lines and the elongated edges of the generally rectangular sheet of material, the transverse score line defining with the proximally angled score lines a generally triangular, trapezoidal rear wall of the blade supporting portion, the side walls of the blade supporting portion and the rear wall of the blade supporting portion defining the blade supporting portion; and (e) an additional transverse score line dividing the remaining material into first and second generally rectangular blade holding panels with the first blade holding panel being disposed adjacent to the rear wall of the blade supporting portion and defining an aperture, the second blade holding panel including a support panel extending from the proximal edge of the sheet of material, the first and second blade holding panels defining a blade holding portion;

whereby when a blade is place between the first and second blade holding panels, the second blade holding panel is folded against the first blade holding panel and the support panel is secured to the blade supporting portion, the blade can extend through the aperture and is held in a stationary position.

12. The disposable, foldable razor of claim 11 wherein the support panel is secured to the rear wall of the blade supporting portion.

13. The disposable, foldable razor of claim 11 wherein the support panel includes at least one extension along a side thereof secured to the blade supporting portion.

14. The disposable, foldable razor of claim 11 wherein the support panel includes a pair of foldable extensions along opposite sides thereof secured to the corresponding side walls of the blade supporting portion.

15. The disposable, foldable razor of claim 11 wherein the first blade holding panel includes a plurality of openings.

16. The disposable, foldable razor of claim 11 wherein the second blade holding panel includes a recessed section adapted to receive the blade.

17. The disposable, foldable razor of claim 16 wherein the blade includes a plurality of openings which correspond to the openings of the first blade holding panel and the recessed section further includes at least one extension that corresponds to the openings defined by the blade and first blade holding panel.

18. The disposable, foldable razor of claim 11 wherein the side walls of the handle portion further include means for securing the side walls together.

19. The disposable, foldable razor of claim 18 wherein the securing means comprises an adhesive.

20. The disposable, foldable razor of claim 18 wherein the securing means includes at least one tab disposed on one side wall of the handle portion and a corresponding cut-out portion disposed on the second side wall of the handle portion.

21. The disposable, foldable razor of claim 11 further including at least one transverse score line extending across the proximally angled score lines and generally parallel the transverse score line which extends from the junction of the proximally angled score lines and the elongated edges of the sheet of material.

* * * * *